US007134742B2

(12) United States Patent
Hatsui et al.

(10) Patent No.: US 7,134,742 B2
(45) Date of Patent: Nov. 14, 2006

(54) INK-JET RECORDING HEAD SUBSTRATE, INK-JET RECORDING HEAD, AND INK-JET RECORDING APPARATUS

(75) Inventors: Takuya Hatsui, Tokyo (JP); Teruo Ozaki, Kanagawa (JP); Yoshiyuki Imanaka, Kanagawa (JP); Satoshi Ibe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 10/975,958

(22) Filed: Oct. 28, 2004

(65) Prior Publication Data

US 2005/0093935 A1 May 5, 2005

(30) Foreign Application Priority Data

Oct. 31, 2003 (JP) ..... 2003-373280
Sep. 2, 2004 (JP) ..... 2004-255870

(51) Int. Cl.
*B41J 2/05* (2006.01)
*B41J 29/38* (2006.01)

(52) U.S. Cl. ..... 347/58; 347/57; 347/12

(58) Field of Classification Search ..... 347/58
See application file for complete search history.

(56) References Cited

U.S. PATENT DOCUMENTS 6,234,598 B1 5/2001 Torgerson et al.
6,409,315 B1 6/2002 Komuro
2001/0052916 A1 12/2001 Komuro
2002/0036781 A1* 3/2002 Hirayama ..... 358/1.4
2002/0145639 A1* 10/2002 Masuda et al. ..... 347/14

FOREIGN PATENT DOCUMENTS

JP 3-292160 A 12/1991

* cited by examiner

*Primary Examiner*—Stephen Meier
*Assistant Examiner*—Han Samuel Choi
(74) *Attorney, Agent, or Firm*—Canon U.S.A. Inc I.P. Div

(57) ABSTRACT

A recording head substrate allowing an increased number of the exothermic bodies driven at a time without increasing the substrate size so as to increase a number of nozzles arranged in high density. The recording head substrate includes a plurality of electrothermal conversion members having exothermic bodies respectively corresponding to a plurality of discharge ports; a plurality of drive elements for driving the exothermic bodies; common wiring A connected to the exothermic bodies; and common wiring B connected to the drive elements; and an electrode pad connected to the common wiring A and the common wiring B. A number of the exothermic bodies driven at a time is determined by (RlineA+RlineB)/(Rh+Rd)<0.05/(0.95 n−1).

8 Claims, 7 Drawing Sheets

INK-JET RECORDING HEAD SUBSTRATE, INK-JET RECORDING HEAD, AND INK-JET RECORDING APPARATUS

CROSS REFERENCE TO RELATED APPLICATIONS

This application claims priority from Japanese Patent Application Nos. 2003-373280 filed Oct. 31, 2003 and 2004-255870 filed Sep. 2, 2004, which are hereby incorporated by reference herein.

BACKGROUND OF THE INVENTION

1. Field of the Invention

The present invention relates to an ink-jet recording head substrate, an ink-jet recording head, and an ink-jet recording apparatus.

2. Description of the Related Art

In an ink-jet recording head, in order to eject a plurality of kinds of ink from one substrate, a plurality of ink supply ports are provided on the one substrate. Additionally, in order to improve the removal performance of ink accumulating on an orifice plate of the one substrate, the substrate is connected to an external instrument by providing electrode pads arranged along sides of the substrate periphery parallel to the shorter side of the groove of each ink supply port. In this configuration, since the distance between an exothermic body and the electrode pad is different regarding the position of the exothermic body, the exothermic body located remote from the electrode pad has been liable to have a large wiring resistance. Accordingly, when a plurality of exothermic bodies connected to one piece of wiring are simultaneously driven from the same electrode pad, the voltage drop in the wiring is increased, so that sufficient electric power does not pervade the exothermic bodies and appropriate bubbles cannot be obtained in comparison with the case that one exothermic body is driven.

Then, as shown in FIG. 7, a configuration in that a line of exothermic bodies is divided into blocks, each block having a plurality of exothermic bodies, and the wiring to an electrode pad is provided for each block so that the wire resistance value for each block is equalized to each other, as disclosed in Japanese Patent Laid-Open No. 10-44416 (corresponding U.S. Pat. No. 6,409,315), for example. In this configuration, by the time-sharing drive in that only one exothermic body is driven within one block at one drive timing, the individual wiring has been achieved in that one exothermic body is driven with one piece of wire at a time.

However, in recent years, there have been demands for ink-jet recording apparatuses that are faster and record with improved image quality. As such, it is necessary for ink-jet recording heads to have more exothermic bodies to be driven with higher frequency. In order to drive a number of exothermic bodies, it is considered to increase the number of time-shared partitions, i.e., the number of exothermic bodies within one block.

By increasing the number of time-shared partitions in such a manner, a number of exothermic bodies can be driven without changing the number of pieces of wiring. However, since a predetermined unit time determined by the frequency is divided into smaller units, a driving time for each exothermic body is reduced. When the exothermic bodies are driven with higher frequency for achieving faster speeds, the driving time is further shortened.

However, in order to stably eject ink, energy applied to each exothermic body needs to be controlled. For this reason, a control technique of changing the driving time has been used. When the driving time of the exothermic body is extremely shortened, a bubble necessary for ejecting ink does not sufficiently grow in the ink, resulting in poor ejection. Accordingly, the driving time of the exothermic body is necessary to some extent, and the driving time is shortened to the limit at present. Therefore, it is difficult to achieve the method as described above.

On the other hand, in order to drive the exothermic body with the same frequency by increasing the number of exothermic bodies without changing the driving time, the number of the exothermic bodies driven at a time is increased, i.e., the number of blocks needs to be increased. In order to drive the exothermic body with higher frequency for achieving the speeding-up, it has been required to reduce the number of time-shared partitions and to increase the number of blocks. With increasing frequency, the driving time of each exothermic body is decreased, so that the minimum driving time is secured by reducing the number of time-shared partitions.

In a conventional wiring method as shown in FIG. 7, the wiring to the electrode pad is individually routed for each block. In order to increase the number of blocks for increasing the number of the exothermic bodies driven at a time, the number of pieces of individual wiring needs to be increased. However, in the individual wiring, the distance from the electrode pad in the substrate periphery to be connected is different regarding the position of the block, so that the length of the wiring is different. Since with increasing length of the wiring, the resistance increases, in order to equalize resistance values by eliminating the wiring resistance differences due to the block position, formerly, the smallest wire in diameter has been used for the block closest to the electrode pad, and with moving distance away from the electrode pad, the wire is increased in diameter. Since the smallest wire diameter has physically a limit, with increasing number of blocks, larger wire in diameter is necessary for the block remote from the electrode pad. As a result, if the number of the exothermic bodies driven at a time is doubled, the wire width increases by three to four times, so that a problem arises that the substrate rapidly increases in size.

SUMMARY OF THE INVENTION

It is an object of the present invention to provide an ink-jet recording head substrate capable of increasing the number of the exothermic bodies driven at a time without increasing the substrate in size for increasing the number of nozzles in high density.

It is another object of the present invention to provide an ink-jet recording head substrate and an ink-jet recording head capable of achieving to speed-up ink-jet recording.

It is another object of the present invention to provide an ink-jet recording head substrate in that the size of the substrate is not changed even when the number of nozzles made and arranged by a film-deposition process is increased, or when the number of the nozzles driven at a time is increased.

It is another object of the present invention to provide an ink-jet recording head substrate and an ink-jet recording head for use in ejecting ink from a discharge port respectively corresponding to a plurality of the discharge ports arranged in a predetermined direction, the ink-jet recording head substrate and the ink-jet recording head including a plurality of electrothermal conversion members, each including a plurality of exothermic bodies arranged along the line of the plurality of discharge ports for use in ejecting ink from the discharge ports respectively corresponding to the plurality of discharge ports and a pair of electrodes connected to the exothermic bodies; a plurality of drive elements, each connected to one of the pair of electrodes of the electrothermal conversion members for driving each of the exothermic bodies; common wiring A connected to the other of the pair of electrodes of the electrothermal conversion members for passing an electric current to the electrothermal conversion members; common wiring B connected to the electrodes provided in the drive elements for passing an electric current to the drive elements; an ink flow path respectively communicated to the discharge ports respectively corresponding to the exothermic bodies; an ink supply port having a quadrilateral opening, longer sides of the opening arranged along the line of the discharge ports, for supplying the ink to the ink flow path; and an electrode pad connected to the common wiring A and the common wiring B as well as to a power supply source, wherein by the rate (RlineA+RlineB)/(Rh+Rd) obtained from the sum of a wiring resistance value RlineA between the electrode pad and the remotest electrothermal conversion member therefrom via the common wiring A and a wiring resistance value RlineB between the electrode pad and the remotest drive element therefrom via the common wiring B, the sum being divided by the sum of a resistance value Rh of the exothermic body and a resistance value Rd of the drive element, the number n ($n \geqq 2$) of the exothermic bodies driven at a time is determined in a range of $(RlineA+RlineB)/(Rh+Rd)<0.05/(0.95\ n-1)$, where n is the number of the exothermic bodies driven at a time among a plurality of the electrothermal conversion members connected to the common wiring A.

It is another object of the present invention to provide an ink-jet recording head substrate and an ink-jet recording head capable of simultaneously driving two or more electrothermal conversion members among a plurality of the electrothermal conversion members connected to the same common wiring without dropping voltage, and stably ejecting ink from a discharge port corresponding to each exothermic body even when the number of the electrothermal conversion members driven at a time is increased, and also capable of corresponding to high-frequency driving by reducing the number of time-shared partitions in the course of the time-sharing driving (i.e., the number of the electrothermal conversion members driven within one frequency can be reduced).

Further objects, features and advantages of the present invention will become apparent from the following description of the preferred embodiments with reference to the attached drawings.

BRIEF DESCRIPTION OF THE DRAWINGS

FIG. 4A is a perspective view; and FIG. 4B is an exploded perspective view of FIG. 4A.

DESCRIPTION OF THE EMBODIMENTS

Embodiments according to the present invention will be described below with reference to the drawings.

Figure 4B:
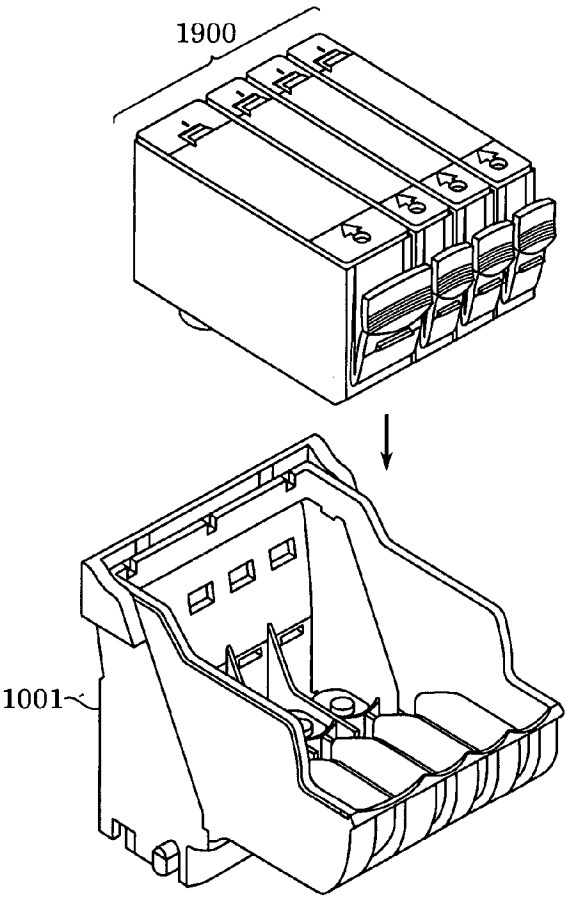
FIGS. 4A and 4B are drawings showing a structure of a recording head cartridge using an ink-jet recording head according to the embodiment of the present invention.
Figure 4A:
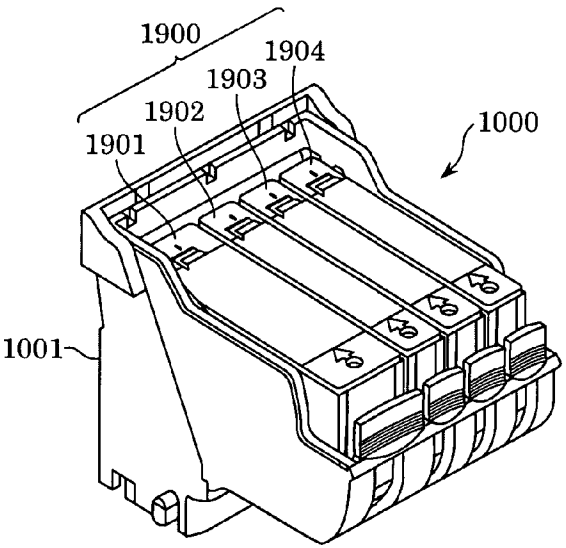

FIGS. 4A and 4B are perspective views showing a recording head cartridge 1000 having a recording head 1001 according to one embodiment of the present invention.

The recording head cartridge 1000 is composed of the recording head 1001 (ink-jet recording head) and an ink tank 1900 (ink tanks 1901, 1902, 1903, and 1904) detachably provided in the recording head 1001. The recording head 1001 ejects ink supplied from the ink tank 1900 through a discharge port in accordance with recording information.

The recording head cartridge 1000 is detachably supported by positioning means and electrical contacts to a carriage (not shown) placed in an ink-jet recording apparatus body.

The recording head 1001 can be, for example, an ink-jet recording head for a recording system using an exothermic body generating thermal energy for producing ink film-boiling corresponding to an electrical signal.

The recording head 1001 includes a recording element unit 1002, an ink supply unit 1003, and a tank holder 2000. In order to communicate an ink-communicating port of the recording element unit 1002 to an ink-communicating port of the ink supply unit 1003 without ink leakage, both units are pressed together with a joint seal member 2300 and fixed with screws 2400.

Figure 5:
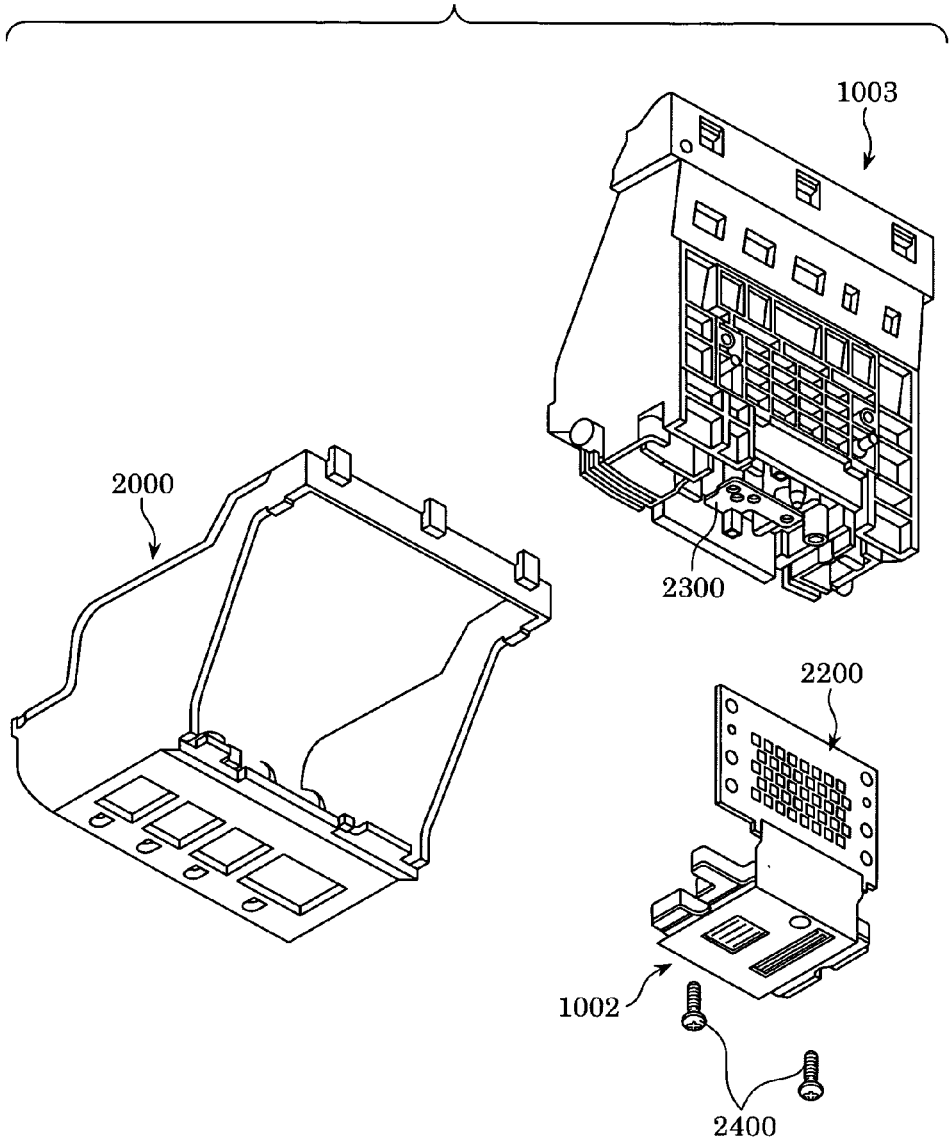
FIG. 5 is an exploded perspective view of the ink-jet recording head shown in FIGS. 4A and 4B.
Figure 6:
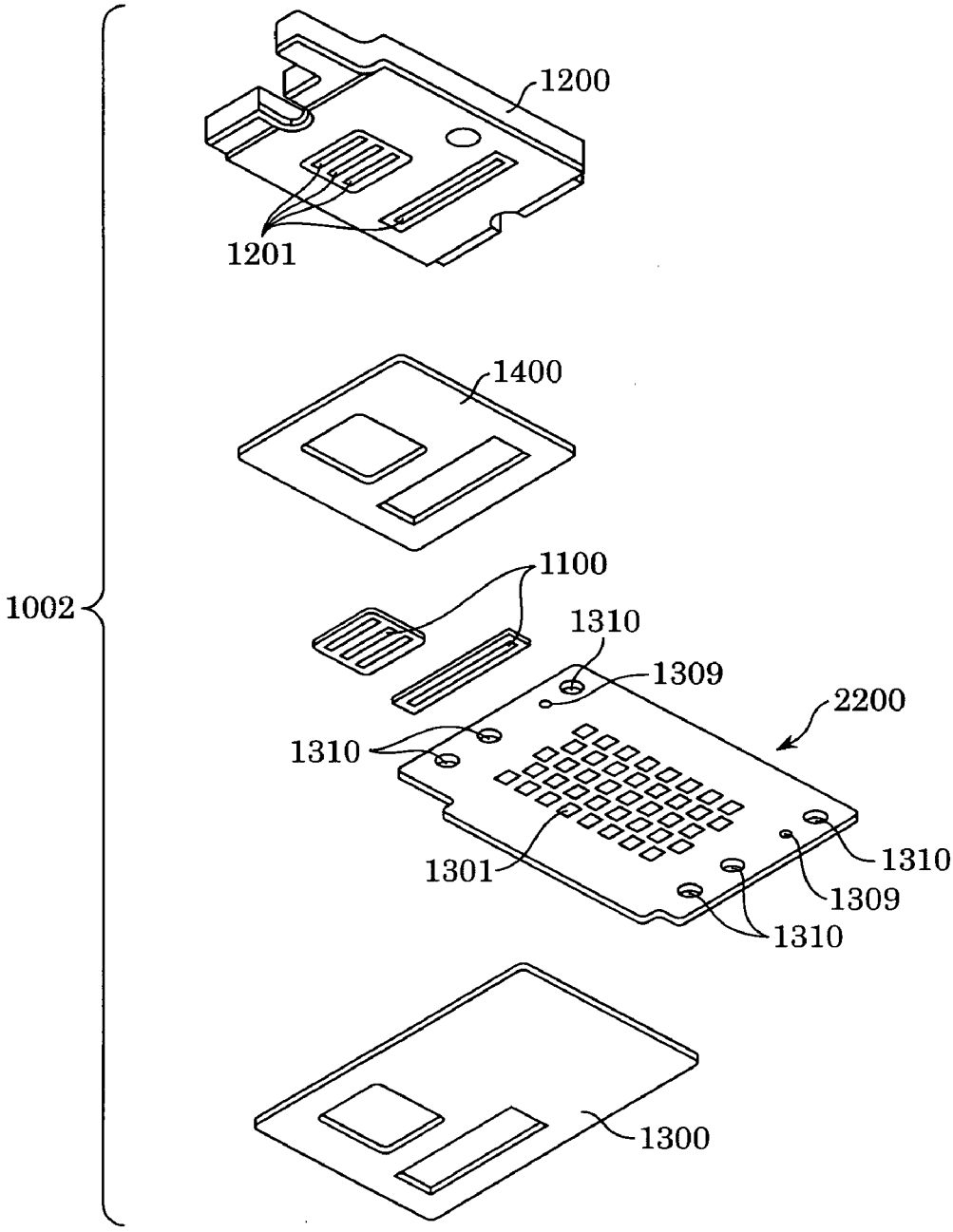
FIG. 6 is an exploded perspective view of a recording element unit shown in FIG. 5.

FIG. 5 is an exploded perspective view of the recording head shown in FIGS. 4A and 4B; FIG. 6 is an exploded perspective view of the recording element unit.

The recording element unit 1002 is composed of two ink-jet recording substrates 1100, a first plate (first support member) 1200, an electrical wiring tape (flexible wiring substrate) 1300, an electrical contact substrate 2200, and a second plate (second support member) 1400.

The ink-jet recording substrates 1100 are fixed to the first plate 1200. Furthermore, the second plate 1400 having an opening is bonded to the first plate 1200. The electrical wiring tape 1300 is bonded to the second plate 1400. In such a manner, the positional relationship of the ink-jet recording substrates 1100 to each member is maintained.

The electrical wiring tape 1300 applies an electrical signal for ejecting ink to the ink-jet recording substrate 1100, and has electrical wiring corresponding to the ink-jet recording substrate 1100 and being connected to the electrical contact substrate 2200 having an external signal input terminal 1301 for receiving an electrical signal from the ink-jet recording apparatus body. The electrical contact substrate 2200 is fixed to the ink supply unit 1003 via two terminal-positioning holes 1309.

Figure 2:
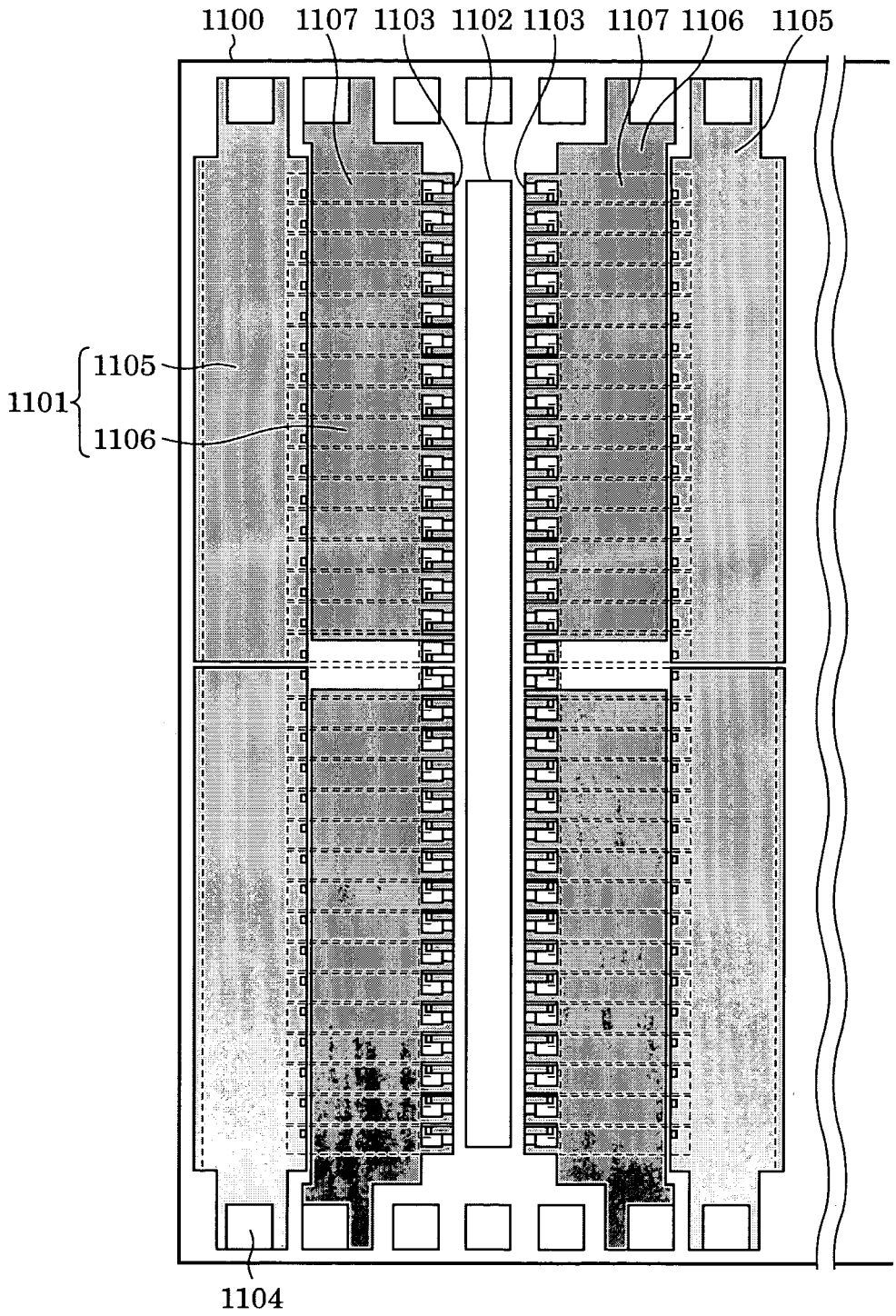
FIG. 2 is a plan view of the ink-jet recording substrate according to the embodiment of the present invention.

FIG. 2 is a plan view of the ink-jet recording substrate 1100.

The ink-jet recording substrate 1100 can be made of, for example, a silicon board with a thickness of 0.5 mm to 1.0 mm and having a plurality of ink paths (not shown) and discharge ports (not shown) formed on one surface of the board by a photolithographic technique. There are provided a plurality of exothermic bodies 1103 corresponding to each of the ink paths. The exothermic bodies 1103 are arranged in a line on both sides about a center line, one line of exothermic bodies 1103 on each side of the center line. Furthermore, the exothermic bodies 1103 are arranged so that the directions alternate (zigzag) about the center line as a symmetrical axis. Moreover, the substrate 1100 is provided with an ink-supply port 1102 formed at the center so as to correspond to an ink-communicating port 1201 formed in the first plate 1200. From the ink-supply port 1102, ink is supplied to the plurality of ink paths. The ink-supply port 1102 is formed to have an opening on the surface (back face) opposite to the surface shown in the drawing. That is, the ink-supply port 1102 is sandwiched between two lines of the exothermic bodies. On the side of the line of the exothermic bodies 1103 opposite to the ink-supply port 1102, drive elements 1107 are arranged for turning on/off to drive the exothermic bodies 1103.

In the ink-jet recording substrate 1100 structured in such a manner, the ink path between the ink-supply port 1102 and the discharge port is filled with ink. When ink is to be ejected, a bubble is generated in the ink by heating the exothermic body 1103 so as to apply the thermal energy to the ink. By the bubble generating pressure, a predetermined amount of ink is ejected as a droplet from the discharge port provided so as to oppose the exothermic body 1103.

An electrical signal from each of electrode pads 1104 provided on the sides of the substrate in a direction perpendicular to the line of the exothermic bodies 1103 is processed and selected in a logic circuit inside the ink-jet recording substrate 1100 so as to feed it to the drive element 1107. The drive element 1107 receives the signal so as to control the driving.

A bump (not shown) on the electrode pad 1104 and an electrode lead (not shown) of the electrical wiring tape 1300 are electrically connected together by a thermosonic compression method.

One end of the exothermic body 1103 is connected to common wiring A1106 while the other end is connected to the drive element 1107 formed below the common wiring A1106. The other end of the drive element 1107 is connected to common wiring B1105. The common wiring A and the common wiring B are divided into two, respectively, so that the line of the exothermic bodies 1103 on one side is divided into two about the center. Each common wiring has two blocks on one side, so that there are four blocks on one side in total, the common wirings A and B. (i.e., one electrothermal conversion member includes exothermic bodies in one block). Thus, there are four blocks on the right and four blocks on the left facing the drawing, eight blocks in total. Each block of the common wiring 1101 (A and B) is connected to the electrode pad 1104, and an electrical signal for ejecting ink is applied to each of the exothermic bodies 1103 and each of the drive elements 1107. The electrode pads 1104 are arranged on both sides of the substrate in a direction perpendicular to the line of the exothermic bodies 1103, and are separately provided for the common wiring A and the common wiring B.

Figure 1:
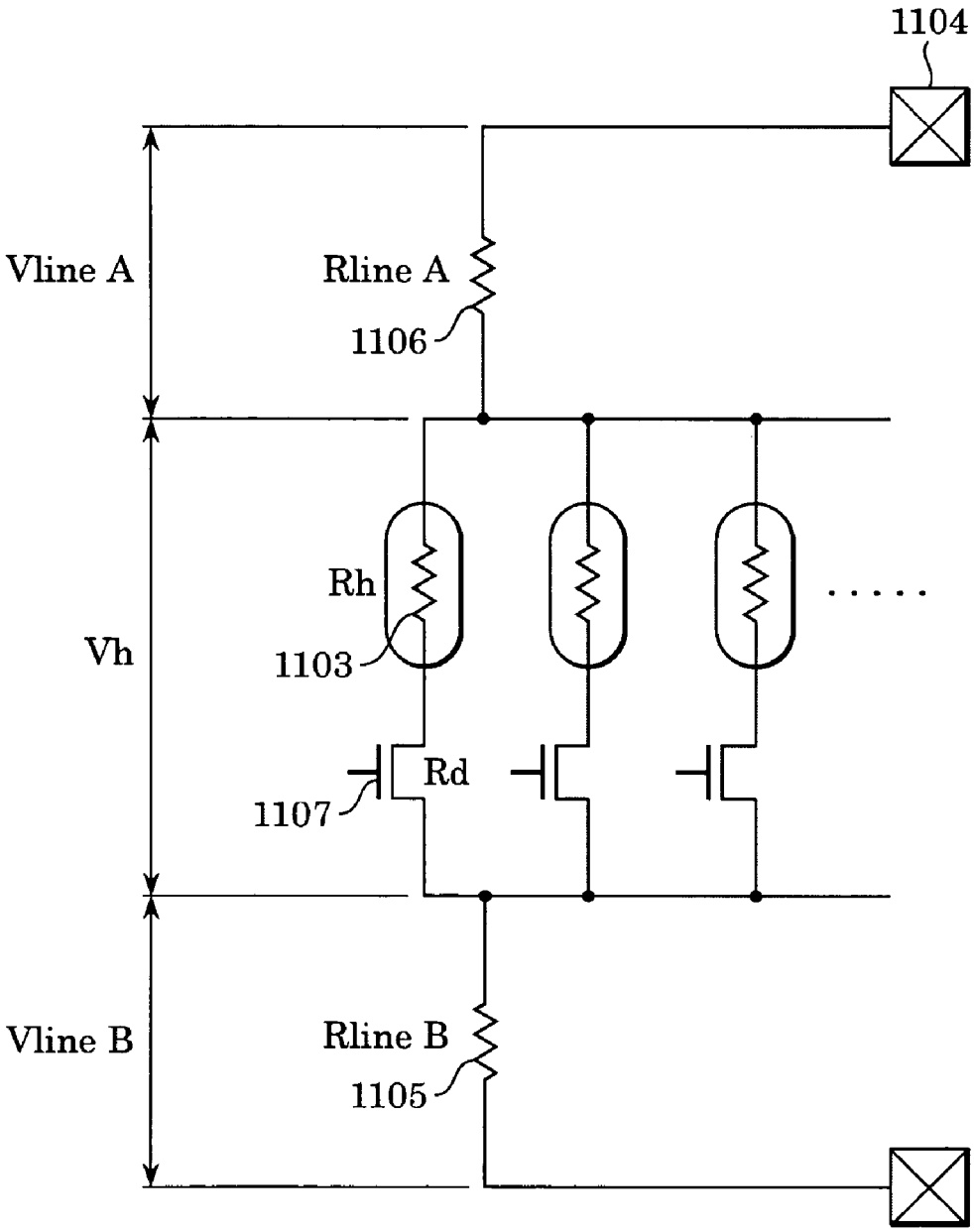
FIG. 1 is an equivalent circuit diagram when an exothermic body of an ink-jet recording substrate according to an embodiment of the present invention is driven.

FIG. 1 is an equivalent circuit diagram of the common wiring 1101, one end of the exothermic body 1103, and the drive element 1107.

Figure 3:
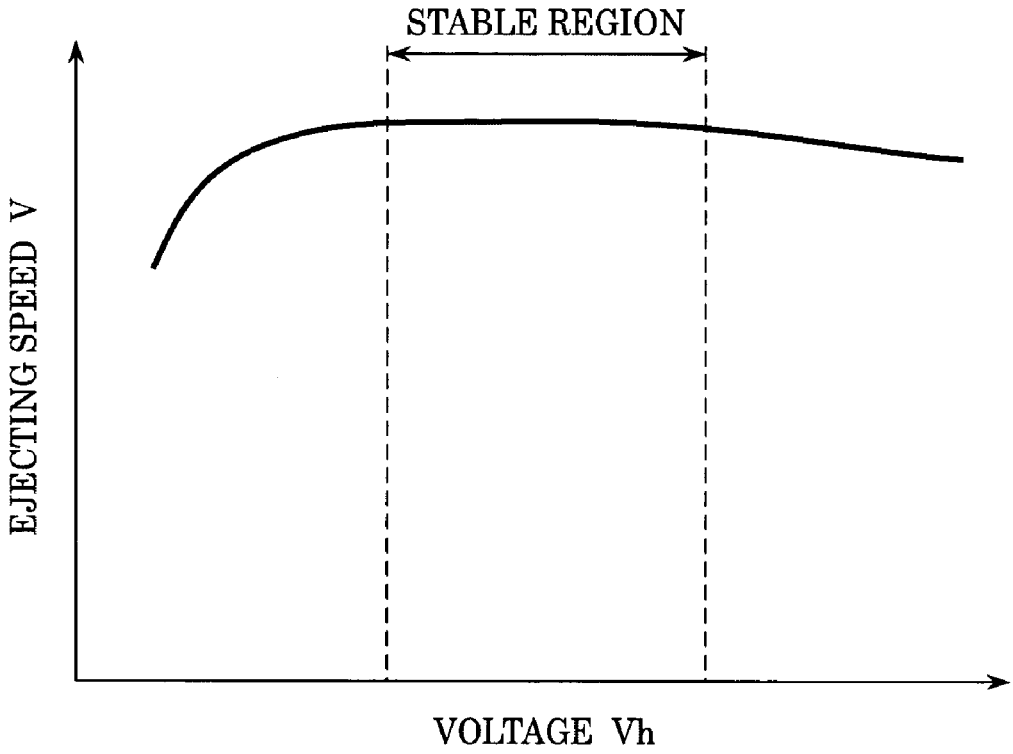
FIG. 3 is a graph showing the relationship between a voltage applied to an exothermic body and an ink ejection speed.

FIG. 3 is a graph showing the relationship between a voltage Vh applied to the exothermic body 1103 and an ejecting speed V of ink.

As shown in FIG. 3, since the ink ejecting speed varies with the voltage, voltage stability is required. In order to stably eject ink in practice, the voltage Vh is maintained in a range of the stable region shown in the drawing. The stable region is within ±5% of the design voltage. However, it is necessary in practice to take into consideration dispersion in resistance values of a plurality of the exothermic bodies 1103 connected in parallel, dispersion in resistance values of the common wiring 1101, and durability of the exothermic bodies 1103. Hence, the fluctuation band of the voltage Vh must be controlled within 5% of the voltage.

Figure 7:
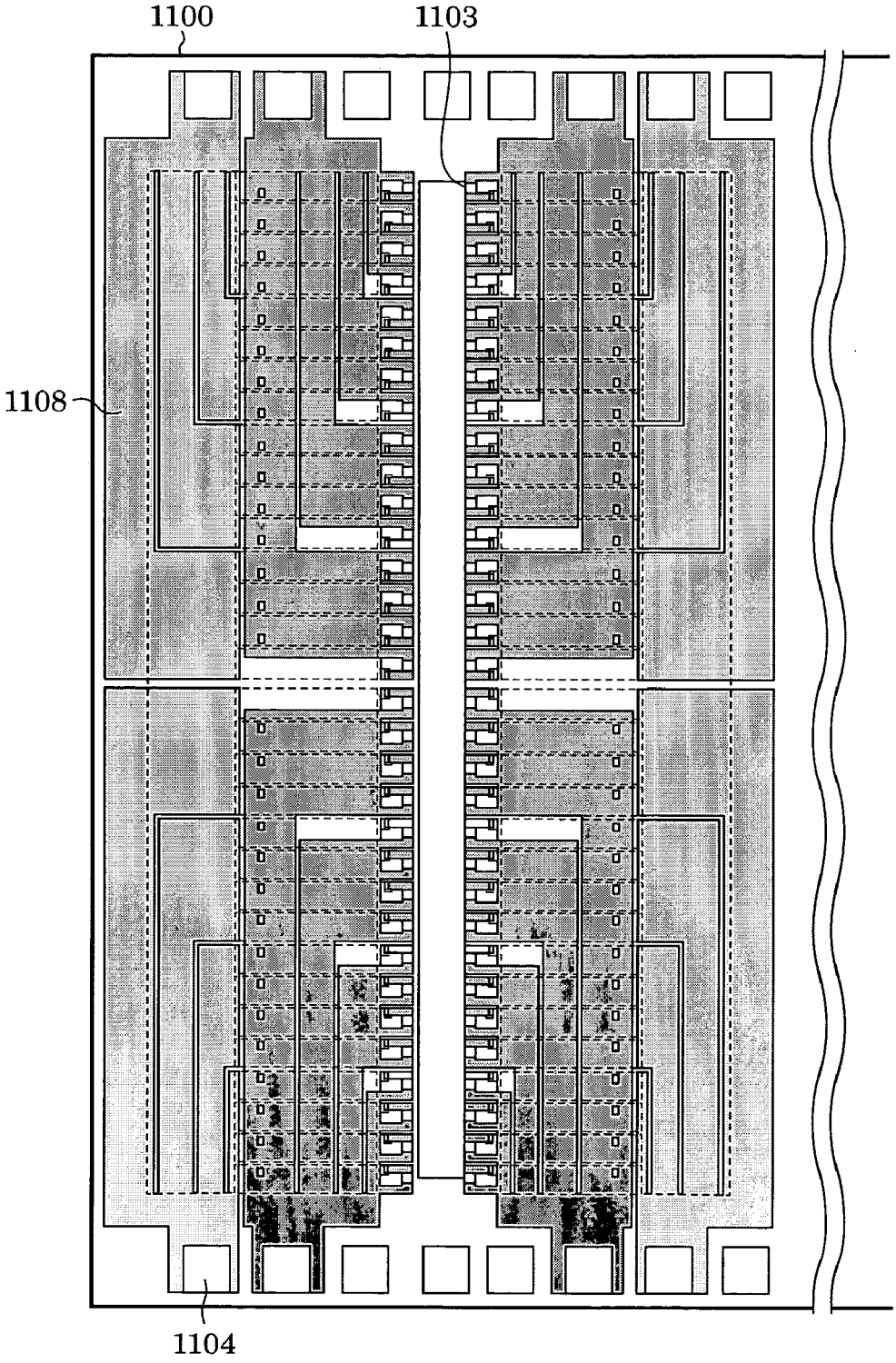
FIG. 7 PRIOR ART
FIG. 7 is a plan view of a conventional ink-jet recording substrate.

As shown in FIG. 7, in order to prevent the voltage from rapidly dropping by maintaining the voltage Vh within a predetermined range, the number of the exothermic bodies 1103 in the identical wiring has been restricted while a plurality of the exothermic bodies 1103 have been controlled not to simultaneously operate in the identical wiring by time-sharing drive. In the conventional wiring divided into blocks, with increasing number of the blocks, wires with wider diameter should be added, so that the substrate increases in size. That is, the conventional configuration has only been on the condition that only one exothermic body is driven at a time in the identical wiring, i.e. in one block, so that the number of the blocks must be increased for increasing the number of the exothermic bodies operating at a time. Considering the relationship between a wiring resistance of a common wiring and exothermic bodies driven at a time by sharing wiring in common was not known conventionally, like in the present invention.

Whereas, according to the present invention, Equation 4 has been found as follows by thinking the relationship between a wiring resistance and exothermic bodies driven at a time. Using this relationship, a plurality of exothermic bodies are enabled to simultaneously operate in identical wiring.

As shown in FIG. 1, according to the embodiment, the number of the exothermic bodies connected to the common wiring is not limited, unlike the conventional configuration. In order to prevent the voltage drop by the number of the exothermic bodies driven at a time, according to the embodiment, it is devised to appropriately establish a resistance value Rline in the common wiring. This will be described below in detail.

The resistance value of the common wiring 1101 is the sum of the wiring resistance value RlineA between the electrode pad 1104 and the remotest exothermic body 1103 therefrom and the wiring resistance value RlineB between the remotest drive element 1107 and the electrode pad 1104. Rh is the resistance value of the exothermic body 1103 and Rd is the resistance value of the drive element 1107.

As shown in FIG. 1, between a pair of the common wirings 1101, when n pieces of the exothermic body 1103 and the drive element 1107 are simultaneously driven, the electric current passing through the wiring resistance RlineA is n times the current passing in the case of only driving one piece of the exothermic body 1103 and the drive element 1107. Hence, the voltage drop of VlineA generated by the wiring resistance is n times as well. This is the same as in the drive terminal side.

In the case where it is defined as the voltage variation rate r of the voltage difference between one exothermic body driven and n pieces of the exothermic body driven, this variation rate r must be suppressed within 5%.

The ratio of wiring resistances satisfying the above relationship will be obtained referring to FIG. 1. If the voltage when one piece is driven is:

$$Vh(1)\cdot Rh/(Rh+Rd)$$

Then, the voltage when n pieces are driven is:

$$Vh(n)\cdot Rh/(Rh+Rd)$$

voltage variation rate: r, $$Vh(1)\cdot Rh/(Rh+Rd)-Vh(n)\cdot Rh/(Rh+Rd)<r\cdot Vh(1)\cdot Rh/(Rh+Rd).$$

Hence, $Vh(1)-Vh(n)<r\cdot Vh(1)$ (Equation 1).

If $RL=RlineA+RlineB$ $RH=Rh+Rd$ $Vop=Vh+VlineA+VlineB,$ $Vh(1)=Vop\cdot RH/(RL+RH)$ (Equation 2)

$Vh(n)=Vop\cdot(RH/n)/((RL+RH/n)$ (Equation 3).

If Equation 2 and Equation 3 are substituted into Equation 1, k=RL/RH, kn−k−knr<r. Hence, RL/RH=k<r/(N−nr−1).

When r is the voltage variation rate within the substrate, and the variation from the case where only one piece is driven is absorbed, the following Equation is obtained:

$$(RlineA+RlineB)/(Rh+Rd)<r/(n-nr-1) \quad \text{(Equation 4)}$$

N: the number of the exothermic bodies driven at a time.

In the case where the variation rate is within 5% as described above, the following Equation is obtained:

$$(RlineA+RlineB)/(Rh+Rd)<0.05/(0.95n-1) \quad \text{(Equation 5).}$$

Hence, if the wiring resistance is determined so as to have RlineA and RlineB satisfying Equation 5, the stable ejection can always be obtained by preventing the rapid voltage drop.

Since the wiring resistance RlineA is determined for a case where the distance between the driven exothermic body 1103 and the electrode pad 1104 is farthest, the rapid voltage drop can be sufficiently prevented in any condition so that a plurality of the exothermic bodies can be simultaneously driven within the common wiring. When the resistance value is verified in more detail, by defining a pattern of nozzles to be simultaneously driven, the value must be verified for the pattern.

As is apparent from the equations, with increasing number of the exothermic bodies driven at a time, the value of (RlineA+RlineB)/(Rh+Rd) decreases. Thus, by having the wiring resistance so as to reduce the value of (RlineA+RlineB) smaller, the number of the exothermic bodies driven at a time can be increased without making the size of the substrate bigger by increasing the number of wirings.

In the conventional example shown in FIG. 7, to each electrode pad 1104, four pieces of the individual wiring 1108 are connected; to each individual wiring 1108, four exothermic bodies are further connected. These four exothermic bodies constitute one block, so that the electrode pad is eventually divided into four blocks. Accordingly, when one exothermic body is driven for each block by the time-sharing drive, the number of the exothermic bodies driven at a time is four for each electrode pad.

In the configuration shown in FIG. 2, when eight exothermic bodies, which is twice to the conventional system described above, is simultaneously driven among 16 exothermic bodies corresponding to a pair of the common wirings 1101 and the variation rate is assumed to be 5%, the value of (RlineA+RlineB)/(Rh+Rd) is obtained by substituting eight into n of Equation 2. Then, the rate (RlineA+RlineB)/(Rh+Rd) of the resistance value (RlineA+RlineB) of the common wiring 1101 to the resistance value during driving the exothermic body 1103 and the drive element 1107 may be maintained 0.0076 at most. When the sum of the resistance value Rh of the exothermic body 1103 and the resistance value Rd during driving the drive element 1107 is assumed to be 400 Ω, the resistance value (RlineA+RlineB) of the common wiring 1101 is 3.00 Ω at most.

The resistance value (RlineA+RlineB) of the practical common wiring 1101 is determined by the thickness and the width of the common wiring and the maximum length between the electrode pad and the exothermic body. For example, when within a band having 256 exothermic bodies 1103 with a one-sided heater pitch of 600 dpi, the actual drive element 1107, and a logic circuit for driving the drive element 1107, Al wiring is performed, if the wiring thickness is at least 0.4 μm, Equation 2 mentioned above can be satisfied. When the band has 512 exothermic bodies 1103, in order to be driven at the same frequency, 16 exothermic bodies H1101 are driven for a pair of the common wirings 1101, so that the resistance value (RlineA+RlineB) of the common wiring 1101 is reduced less than 1.39 Ω while the thickness of the common wiring 1101 is increased more than 1.5 μm.

The allowable voltage variation range is practically limited not only by the nozzle driving but also by the voltage variation of the electric power supplied to the recording head. Thus, the number of the exothermic bodies driven at a time and the wiring resistance value be established by also taking the voltage variation on the supply side into consideration. In order to satisfy the equations according to the present invention, the thickness of the common wiring 1101 may be increased using a different metal, such as gold plating, or the resistance value of the exothermic body 1103 may also be increased. Also, the present invention is especially effective when the substrate having a plurality of the ink-supply ports 1102 incorporates the invention.

According to the present invention, since the number of exothermic bodies driven at a time can be determined regardless of the number of wirings in the ink-jet recording substrate, the speeding up and the densification can be achieved in the same width of the substrate.

By further reducing the resistance value rate (RlineA+RlineB)/(Rh+Rd), more exothermic bodies can be simultaneously driven without changing a routing manner of wiring, resulting in reducing the number of time-shared partitions and speeding up the recording.

By reducing the wiring resistance value rate, the heat evolution not due to the exothermic body is reduced, enabling the drive to be efficient.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording head substrate having a plurality of discharge ports arranged in a predetermined direction, the substrate comprising:

a plurality of electrothermal conversion members, each comprising a plurality of exothermic bodies arranged along the line of the plurality of discharge ports for use in ejecting ink from the discharge ports respectively corresponding to the plurality of discharge ports and a pair of electrodes connected to the exothermic bodies;

a plurality of drive elements, each connected to one of the pair of electrodes of the electrothermal conversion members for driving each of the exothermic bodies;

common wiring A connected to the other of the pair of electrodes of the electrothermal conversion members for passing an electric current to the electrothermal conversion members;

common wiring B connected to the electrodes provided in the drive elements for passing an electric current to the drive elements;

an ink flow path respectively communicated to the discharge ports respectively corresponding to the exothermic bodies;

an ink supply port having a quadrilateral opening, longer sides of the opening arranged along the line of the discharge ports, for supplying the ink to the ink flow path; and an electrode pad connected to the common wiring A and the common wiring B as well as to a power supply source, wherein by the rate (RlineA+RlineB)/(Rh+Rd) obtained from the sum of a wiring resistance value RlineA between the electrode pad and the remotest electrothermal conversion member therefrom via the common wiring A and a wiring resistance value RlineB between the electrode pad and the remotest drive element therefrom via the common wiring B, the sum being divided by the sum of a resistance value Rh of the exothermic body and a resistance value Rd of the drive element, a logic circuit driving the number n ($n \geqq 2$) of the exothermic bodies at a time is determined in a range of $(RlineA+RlineB)/(Rh+Rd)<0.05/(0.95\ n-1)$, where n is the number of the exothermic bodies driven at a time among a plurality of the electrothermal conversion members connected to the common wiring A.

2. The substrate according to claim 1, wherein the logic circuit that simultaneously selects n ($n \geqq 2$) electrothermal conversion members from the electrothermal conversion members that are connected to the common wiring A so as to be driven, wherein the resistance value (RlineA+RlineB) enables the electrothermal conversion members selected by the logic circuit to be driven.

3. The substrate according to claim 1, wherein the electrode pads are arranged along a direction different from the arrangement direction of the exothermic bodies in the vicinity of the ink-jet recording head substrate.

4. The substrate according to claim 1, wherein the common wiring A and the common wiring B satisfy the resistance values RlineA and RlineB, respectively, by thickening a metallic film for wiring.

5. The substrate according to claim 4, wherein the common wiring is gold wiring and the thickening the metallic film is to form thick film wiring by plating.

6. An ink-jet recording head comprising:

the ink-jet recording head substrate according to claim 1; and an electrical wiring member for transmitting an external drive signal to the ink-jet recording head substrate.

7. The head according to claim 6, wherein a bubble is generated in ink by driving the electrothermal conversion member so as to apply thermal energy generated in the exothermic body to ink, which is ejected from the discharge port as a droplet by a bubble generating pressure.

8. An ink-jet recording apparatus comprising:

the ink-jet recording head according to claim 6; and a carriage capable of scanning the drive signal while mounting the ink-jet recording head thereon.

* * * * *